US008912961B2

(12) United States Patent
Hallivuori

(10) Patent No.: US 8,912,961 B2
(45) Date of Patent: Dec. 16, 2014

(54) APPARATUS FOR WIRELESS COMMUNICATION

(75) Inventor: Juha Samuel Hallivuori, Tampere (FI)

(73) Assignee: Nokia Corporation, Espoo (FI)

( * ) Notice: Subject to any disclaimer, the term of this patent is extended or adjusted under 35 U.S.C. 154(b) by 686 days.

(21) Appl. No.: 12/584,664

(22) Filed: Sep. 9, 2009

(65) Prior Publication Data

US 2011/0057843 A1 Mar. 10, 2011

(51) Int. Cl.

| | |
|---|---|
| ***H01Q 1/24*** | (2006.01) |
| ***H01Q 1/52*** | (2006.01) |
| ***H01Q 5/00*** | (2006.01) |
| ***H01Q 9/42*** | (2006.01) |
| ***H01Q 7/00*** | (2006.01) |

(52) U.S. Cl.

CPC ..... *H01Q 1/243* (2013.01); *H01Q 1/52* (2013.01); *H01Q 5/0048* (2013.01); *H01Q 9/42* (2013.01); *H01Q 7/00* (2013.01)

USPC ..... 343/702

(58) Field of Classification Search

CPC ..... H01Q 1/52; H01Q 1/243; H01Q 9/42

USPC ..... 343/700 MS, 702

See application file for complete search history.

(56) References Cited

U.S. PATENT DOCUMENTS

| | | | | |
|---|---|---|---|---|
| 7,342,539 | B2 | 3/2008 | Rosenberg et al. | 343/702 |
| 2002/0018021 | A1 | 2/2002 | Koyanagi et al. | 343/702 |
| 2002/0101382 | A1 | 8/2002 | Konishi et al. | 343/702 |
| 2003/0078012 | A1 | 4/2003 | Ito et al. | 455/82 |
| 2005/0140564 | A1 | 6/2005 | Deguchi et al. | 343/866 |
| 2006/0145923 | A1* | 7/2006 | Autti | 343/700 MS |
| 2006/0262018 | A1* | 11/2006 | Mikami et al. | 343/713 |
| 2007/0247374 | A1* | 10/2007 | Nishikido et al. | 343/702 |
| 2008/0136727 | A1 | 6/2008 | Bit-Babik | 343/848 |
| 2008/0143631 | A1* | 6/2008 | Autti | 343/845 |
| 2008/0252536 | A1* | 10/2008 | Anguera et al. | 343/702 |
| 2009/0073055 | A1 | 3/2009 | Kinezos et al. | 343/702 |

FOREIGN PATENT DOCUMENTS

| | | | |
|---|---|---|---|
| EP | 0604304 | A1 | 6/1994 |
| EP | 1 788 663 | A1 | 5/2007 |
| EP | 1788663 | A1 | 5/2007 |
| JP | 2000244219 | A | 9/2000 |
| JP | 200910032 | A | 5/2006 |
| JP | 2008017384 | A | 1/2008 |
| JP | 2008278414 | A | 11/2008 |
| JP | 2008294748 | A | 12/2008 |
| JP | 2009060268 | A | 3/2009 |
| WO | WO-2009/031229 | A1 | 3/2009 |
| WO | WO-2009/093591 | A1 | 7/2009 |

OTHER PUBLICATIONS

Hayashida et al , "Wideband Folded Loop Antenna for Handsets," 2002.

* cited by examiner

*Primary Examiner* — Robert Karacsony

(74) *Attorney, Agent, or Firm* — Harrington & Smith

(57) ABSTRACT

Apparatus including a ground member oriented in a first orientation; and an antenna including a first portion having a non-overlaying arrangement with the ground member, the first portion being oriented in a second orientation, different to the first orientation.

18 Claims, 7 Drawing Sheets

APPARATUS FOR WIRELESS COMMUNICATION

FIELD OF THE INVENTION

Embodiments of the present invention relate to apparatus for wireless communication. In particular, they relate to apparatus for wireless communication in a portable electronic device.

BACKGROUND TO THE INVENTION

Apparatus, such as mobile cellular telephones, usually include one or more antennas for enabling the apparatus to communicate wirelessly with other such apparatus. The apparatus may include electronic components (such as a display, a processor, a memory and so on) mounted on a printed wiring board. These components may electromagnetically interfere with the antenna and cause noise in a received and/or transmitted signal.

It would therefore be desirable to provide an alternative apparatus.

BRIEF DESCRIPTION OF VARIOUS EMBODIMENTS OF THE INVENTION

According to various, but not necessarily all, embodiments of the invention there is provided apparatus comprising: a ground member oriented in a first orientation; and an antenna including a first portion having a non-overlaying arrangement with the ground member, the first portion being oriented in a second orientation, different to the first orientation.

The apparatus may be for wireless communications.

The orientation of the first portion may be configured to provide the antenna with a radiation pattern including a main lobe oriented away from a noise source.

The antenna may include a second portion having an overlaying arrangement with the ground member. The second portion may be configured to have an electrical length that enables the antenna to operate efficiently in at least a first operational frequency band. The second portion may have an orientation that is configured to provide the antenna with a radiation pattern including a main lobe oriented away from a noise source.

The antenna may include a third portion, extending from the first portion, having an overlaying arrangement with the ground member, the third portion being configured to have an electrical length that enables the antenna to operate efficiently in at least a first operational frequency band. The third portion may have an orientation that is configured to provide the antenna with a radiation pattern including a main lobe oriented away from a noise source.

The apparatus may further comprise radio circuitry configured to process signals from the antenna. A connection between the antenna and the radio circuitry is without an amplifier.

The ground member may comprise a top surface and a bottom surface. The first portion may extend from above the top surface of the ground member to beneath the bottom surface of the ground member.

The ground member may comprise a top surface and a bottom surface. The first portion may be positioned wholly above the top surface of the ground member.

The first orientation may be substantially perpendicular to the second orientation.

According to various, but not necessarily all, embodiments of the invention there is provided a portable electronic device comprising apparatus as describe in any of the above paragraphs.

According to various, but not necessarily all, embodiments of the invention there is provided a module comprising apparatus as described in any of the above paragraphs.

The module may further comprise a cover for a portable electronic device. The antenna may be incorporated into the cover.

According to various, but not necessarily all, embodiments of the invention there is provided a method comprising: providing a ground member oriented in a first orientation; and providing an antenna including a first portion having a non-overlaying arrangement with the ground member and the first portion being oriented in a second orientation, different to the first orientation.

The method may further comprise configuring the orientation of the first portion to provide the antenna with a radiation pattern including a main lobe oriented away from a noise source.

The antenna may include a second portion having an overlaying arrangement with the ground member. The method may further comprise configuring the second portion to have an electrical length that enables the antenna to operate efficiently in at least a first operational frequency band.

The method may further comprise configuring an orientation of the second portion to provide the antenna with a radiation pattern including a main lobe oriented away from a noise source.

The antenna may include a third portion, extending from the first portion, having an overlaying arrangement with the ground member. The method may further comprise configuring the third portion to have an electrical length that enables the antenna to operate efficiently in at least a first operational frequency band.

The method may further comprising configuring an orientation of the third portion to provide the antenna with a radiation pattern including a main lobe oriented away from a noise source.

The method may further comprise providing radio circuitry configured to process signals from the antenna. A connection between the antenna and the radio circuitry may be without an amplifier.

The ground member may comprise a top surface and a bottom surface. The first portion may extend from above the top surface of the ground member to beneath the bottom surface of the ground member.

The ground member may comprise a top surface and a bottom surface. The first portion may be positioned wholly above the top surface of the ground member.

The first orientation may be substantially perpendicular to the second orientation.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 2:
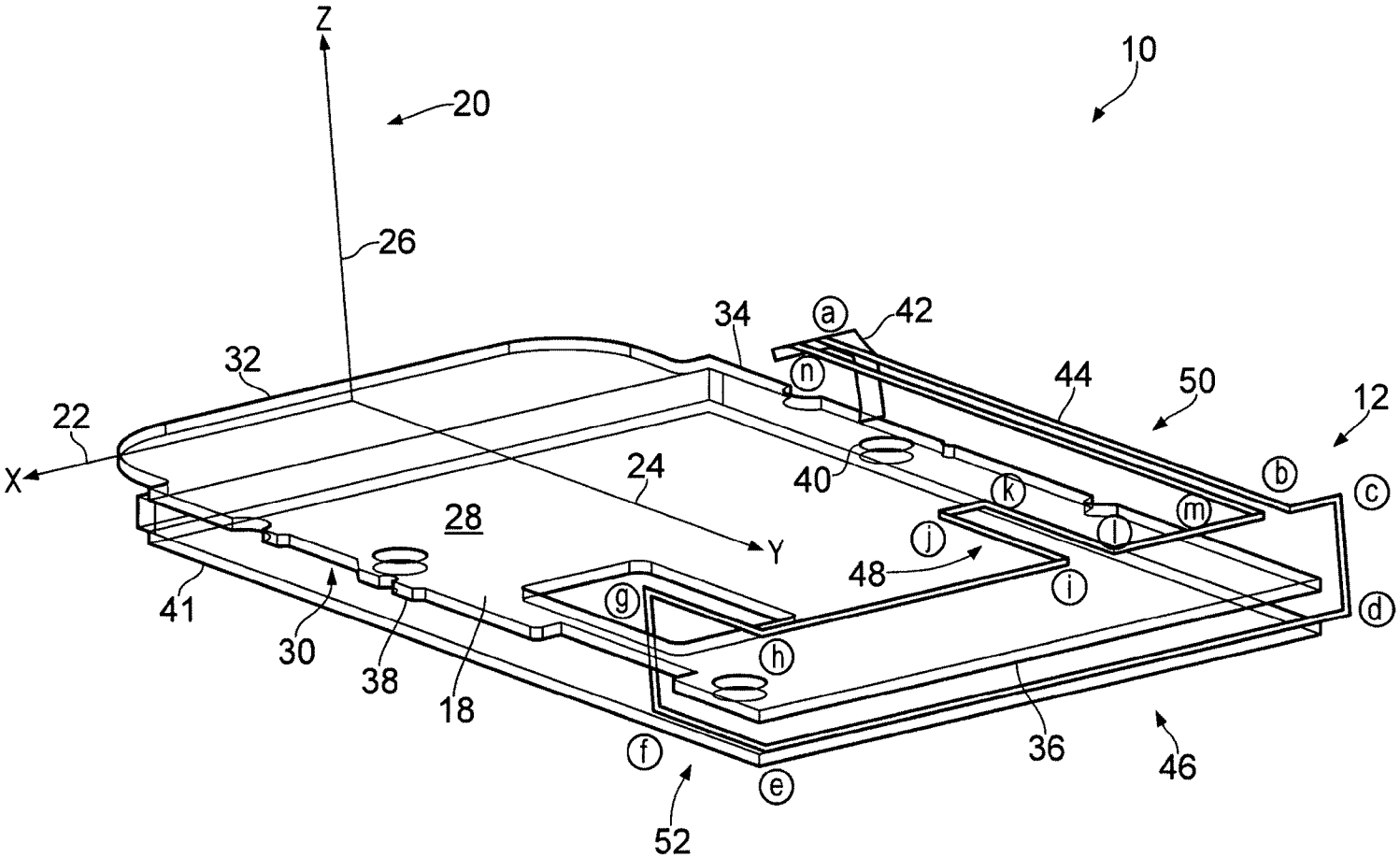
FIG. 2 illustrates a perspective view of an apparatus according to various embodiments of the invention.

FIG. 2 illustrates apparatus 10 comprising: a ground member 18 oriented in a first orientation; and an antenna 12 including a first portion 46 having a non-overlaying arrangement with the ground member 18, the first portion 46 being oriented in a second orientation, different to the first orientation.

In the following description, the wording 'connect' and 'couple' and their derivatives mean operationally connected/coupled. It should be appreciated that any number or combination of intervening components can exist (including no intervening components). Additionally, it should be appreciated that the connection/coupling may be a physical galvanic connection and/or an electromagnetic connection.

Figure 1:
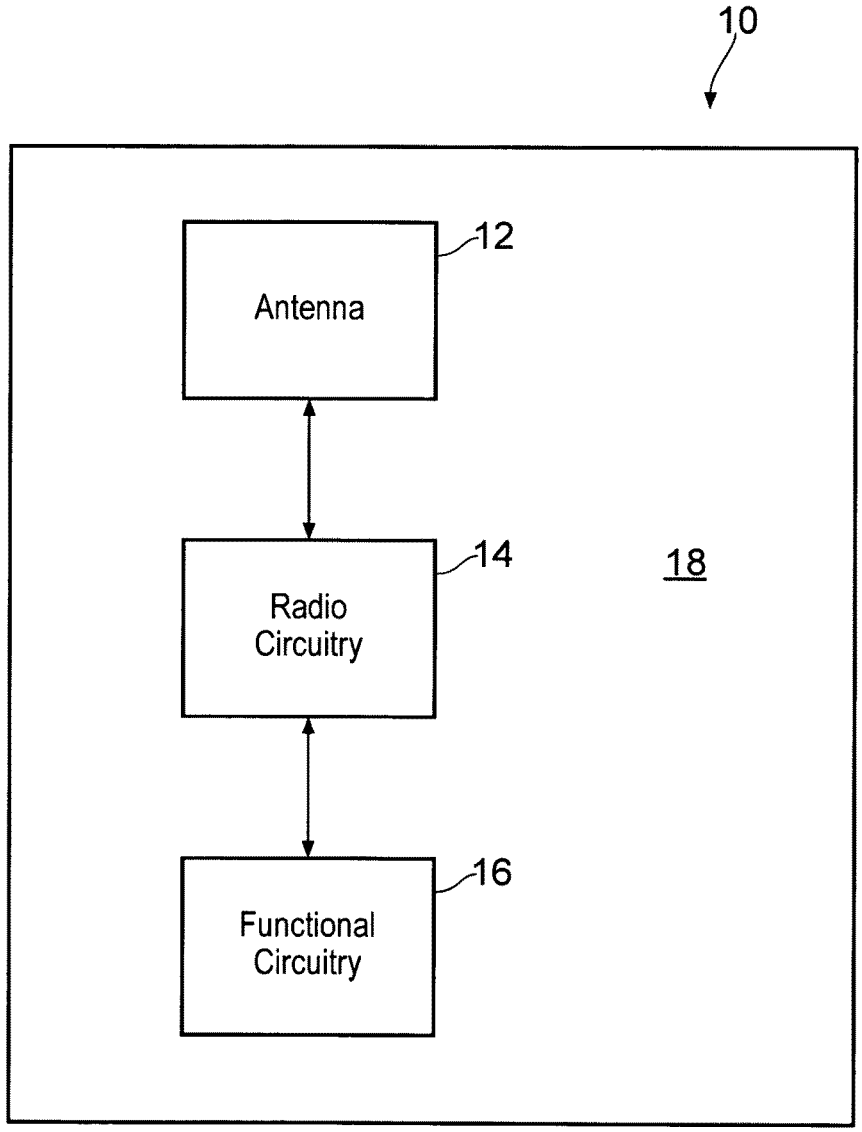
FIG. 1 illustrates a schematic diagram of an apparatus according to various embodiments of the invention.

FIG. 1 illustrates an apparatus 10 such as an electronic device which may be a portable electronic communication device (for example, a mobile cellular telephone, a personal digital assistant or any hand held computer) or a module for such devices. As used here, 'module' refers to a unit or apparatus that excludes certain parts/components that would be added by an end manufacturer or a user.

The apparatus 10 comprises an antenna 12, radio circuitry 14 and functional circuitry 16. The antenna 12 is configured to transmit and/or receive electromagnetic signals and will be described in more detail in the following paragraphs. The radio circuitry 14 is connected between the antenna 12 and the functional circuitry 16 and may include a receiver and/or a transmitter. The functional circuitry 16 is operable to provide signals to, and/or receive signals from the radio circuitry 14.

The antenna 12 and the radio circuitry 14 may be configured to operate in a plurality of different operational frequency bands and via a plurality of different protocols. For example, the different operational frequency bands and protocols may include (but are not limited to) Long Term Evolution (LTE) 700 (US) (698.0-716.0 MHz, 728.0-746.0 MHz), LTE 1500 (Japan) (1427.9-1452.9 MHz, 1475.9-1500.9 MHz), LTE 2600 (Europe) (2500-2570 MHz, 2620-26 90 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); helical local area network (HLAN) (5150-5850 MHz); global positioning system (GPS) (1570.42-1580.42 MHz); US-Global system for mobile communications (US-GSM) 850 (824-894 MHz); European global system for mobile communications (EGSM) 900 (880-960 MHz); European wideband code division multiple access (EU-WCDMA) 900 (880-960 MHz); personal communications network (PCN/DCS) 1800 (1710-1880 MHz); US wideband code division multiple access (US-WCDMA) 1900 (1850-1990 MHz); wideband code division multiple access (WCDMA) 2100 (Tx: 1920-1980 MHz Rx: 2110-2180 MHz); personal communications service (PCS) 1900 (1850-1990 MHz); ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

An operational frequency band is a frequency range over which an antenna and radio circuitry can efficiently operate using a protocol. Efficient operation occurs, for example, when the antenna's insertion loss S11 is greater than an operational threshold such as 4 dB or 6 dB.

In the embodiment where the apparatus 10 is a portable device, the functional circuitry 16 may include a processor, a memory and input/output devices such as an audio input device (a microphone for example), an audio output device (a loudspeaker for example) and a display. The electronic components that provide the radio circuitry 14 and the functional circuitry 16 may be interconnected via a printed wiring board (PWB) 18. In various embodiments the printed wiring board 18 may be used as a ground member for the antenna 12 by using one or more layers of the printed wiring board 18. In these embodiments, the ground member (that is, the printed wiring board) is a ground plane for the antenna 12. In other embodiments, some other conductive part of the apparatus 10 (a battery cover for example) may be used as a ground member for the antenna 12. In these embodiments, the ground member may be non-planar.

FIG. 2 illustrates a perspective view of an apparatus 10 according to various embodiments of the present invention. The apparatus 10 includes an antenna 12 and a printed wiring board 18. FIG. 2 also illustrates a Cartesian co-ordinate system 20 that includes an X axis 22, a Y axis 24 and a Z axis 26. The X axis 22, the Y axis 24 and the Z axis 26 are orthogonal relative to one another.

The printed wiring board 18 is substantially rectangular and is oriented in a first orientation that is substantially parallel to the plane defined by the X axis 22 and the Y axis 24. The printed wiring board 18 has a top surface 28, a bottom surface 30, a first side edge 32, a second side edge 34, a third side edge 36 and a fourth side edge 38. The top surface 28 and the bottom surface 30 are oriented substantially parallel to the plane defined by the X axis 22 and the Y axis 24. The first and third side edges 32, 36 are substantially parallel to the X axis 22 and the second and fourth side edges 34, 38 are substantially parallel to the Y axis 24. The first and third side edges 32, 36 are shorter in length than the second and fourth side edges 34, 38. The top surface 28 of the printed wiring board 18 includes one or more feed points 40 that are connected to the radio circuitry 14 (illustrated in FIG. 1) and are positioned adjacent, and approximately half way along the length of, the second side edge 34.

The apparatus 10 may also include an additional ground member 41 that is positioned underneath the printed wiring board 18 (that is, adjacent the bottom surface 30 of the printed wiring board 18). The additional ground member 41 is also oriented in the first orientation and is consequently substantially parallel to the printed wiring board 18.

The antenna 12 includes a feed leg 42 that is connectable to the feed point(s) 40 on the printed wiring board 18, and a conductive track 44 that extends from the feed leg 42 and is arranged in a loop-like structure. In this embodiment, the antenna 12 is a balanced antenna (that is, the antenna 12 is not physically connected to ground). In other embodiments, the antenna 12 may be a monopole radiator with one feed connected to the radio circuitry 14 and one feed connected to an open circuit (via a switch for example). In this example embodiment, the switch configures the antenna to operate as a loop antenna when the switch is closed, and when the switch is open, the switch configures the antenna to operate as a monopole antenna, or linear antenna. For example, the monopole mode may be used for FM transmission and the loop mode may be used for FM reception.

The feed leg 42 may provide two tracks to the printed wiring board 18, so that separate feeds are connected as balanced feeds to the radio circuitry 14. The illustrated feed leg 42 includes a plastic carrier or similar mechanical holding component for the two tracks to the printed wiring board 18.

In more detail, the conductive track 44 extends at a position (a) from the feed leg 42 in the +Y direction until position (b). At position (b), the conductive track 44 has a right angled turn and extends in the −X direction until position (c). At position (c), the conductive track 44 has a right angled turn and extends in the −Z direction until position (d). At position (d), the conductive track 44 has a right angled turn and extends in the +X direction until position (e). At position (e), the conductive track 44 has a right angled turn and extends in the −Y direction until position (f). At position (f), the conductive track 44 has a right angled turn and extends in the +Z direction until position (g). At position (g), the conductive track 44 has a right angled turn and extends in the +Y direction until position (h). At position (h), the conductive track 44 has a right angled turn and extends in the −X direction until position (i). At position (i), the conductive track 44 has a right angled turn and extends in the −Y direction until position (j). At position (j), the conductive track 44 has a right angled turn and extends in the −X direction until position (k). At position (k), the conductive track 44 has a right angled turn and extends in the +Y direction until position (l). At position (l), the conductive track 44 has a right angled turn and extends in the −X direction until position (m). At position (m), the conductive track 44 extends in the −Y direction until position (n). At position (n), the conductive track 44 is connected to the feed leg 42.

The length of the conductive track 44 between positions (a) and (b) is greater than the length of the printing wiring board 18 from the feed point(s) 40 to the third side edge 36. Additionally, the length of the conductive track 44 between positions (d) and (e) is greater than the length of the third side edge 36. Consequently, the conductive track 44 is arranged around, and positioned outside of the perimeter of the printed wiring board between positions (b) to (i) and (l) to (m). In other words, the conductive track 44 between positions (b) to (i) and (l) to (m) does not substantially overlay the printed wiring board 18.

The length of the conductive track 44 between positions (i) to (j) and between positions (k) to (l) is such that the conductive track 44, between positions (i) to (l), extends inside the perimeter of the printed wiring board 18. In other words, the conductive track 44 between positions (i) to (l) substantially overlays the printed wiring board 18.

The conductive track 44 between positions (a) to (b) and between positions (m) to (n) extends within the perimeter of the printed wiring board 18. In other words, the conductive track 44 between positions (a) to (b) and (m) to (n) substantially overlays the printed wiring board 18.

The length of the conductive track 44 between positions (c) to (d) and between positions (f) to (g) is greater than the height of the conductive track 44 at position (c) above the printed wiring board 18. Consequently, between positions (c) to (d), the conductive track 44 extends from above the top surface 28 of the printed wiring board 18 to beneath the bottom surface 30 of the printed wiring board 18. Between positions (f) to (g), the conductive track 44 extends from beneath the bottom surface 30 of the printed wiring board 18 to above the top surface 28 of the printed wiring board 18.

The antenna 12 may be considered to comprise a plurality of portions. A first portion 46 is provided by the conductive track 44 between positions (b) to (e), (h) to (i) and (l) to (m). A second portion 48 is provided by the conductive track 44 between positions (i) to (l). A third portion 50 is provided by the conductive track 44 between positions (a) to (b) and (m) to (n). A fourth portion 52 is provided by the conductive track 44 between positions (e) to (h).

The first portion 46 has a second orientation, different to the first orientation of the printed wiring board 18. In more detail, the first portion 46 lies in a plane that is substantially parallel with the plane defined by the X axis 22 and the Z axis 26. Since the printed wiring board 18 has an orientation that is substantially parallel to the plane defined by the X axis 22 and the Y axis 24, it should be appreciated that the first portion 46 has an orientation that is substantially perpendicular to the orientation of the printed wiring board 18. Additionally and as mentioned above, the first portion 46 is in a non-overlaying arrangement with the printed wiring board 18. In other words, the first portion 46 is positioned outside of the perimeter of the printed wiring board 18. The first portion 46 is also in a non-overlaying arrangement with the additional ground member 41. Furthermore, the first portion 46 extends from above the top surface 28 to beneath the bottom surface 30 of the printed wiring board 18.

The second portion 48 lies in a plane that is substantially parallel with the plane defined by the X axis 22 and the Y axis 24. Consequently, it should be appreciated that the second portion 48 has an orientation that is substantially parallel to the orientation of the printed wiring board 18 (that is, they have substantially the same orientation). Furthermore, the second portion 48 is in an overlaying arrangement with the printed wiring board 18. In other words, the second portion 48 is positioned within the perimeter of the printed wiring board 18.

The third portion 50 lies in a plane that is substantially parallel with the plane defined by the X axis 22 and the Y axis 24. Consequently, it should be appreciated that the third portion 50 has an orientation that is substantially parallel to the orientation of the printed wiring board 18. Furthermore, the third portion 50 is in an overlaying arrangement with the printed wiring board 18.

The fourth portion 52 lies in a plane that is substantially parallel with the plane defined by the Y axis 24 and the Z axis 26. Consequently, the fourth portion 52 has an orientation that is substantially perpendicular to the orientation of the printed wiring board 18. Additionally and as mentioned above, the fourth portion 52 is in a non-overlaying arrangement with the printed wiring board 18 and extends from above the top surface 28 to beneath the bottom surface 30 of the printed wiring board 18.

In operation, the antenna 12 is connected to the radio circuitry 14 via the feed point(s) 40 and may transmit signals received from the radio circuitry 14 and/or receive signals from a further apparatus (a base station or broadcast transmitter for example) and provide the received signals to the radio circuitry 14 for processing.

Figure 3:
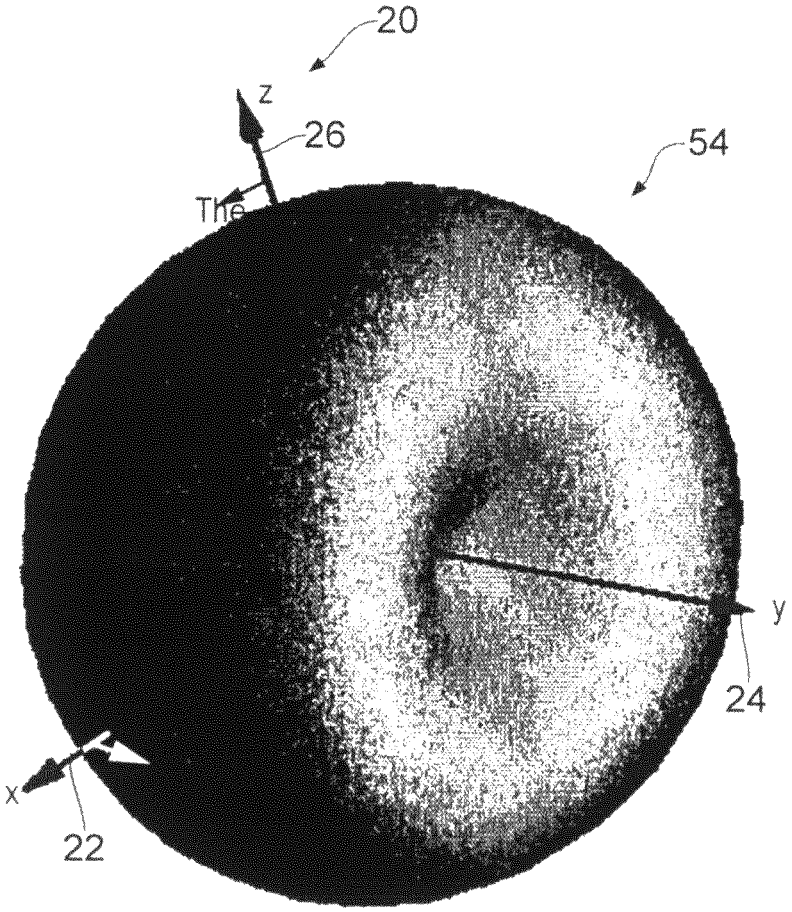
FIG. 3 illustrates a radiation diagram of the apparatus illustrated in FIG. 2.

FIG. 3 illustrates a diagram of a radiation pattern 54 of the antenna 12 and the Cartesian co-ordinate system 20 (also illustrated in FIG. 2). As mentioned above, the antenna 12 may be used to transmit and/or receive signals and it should be appreciated that the radiation pattern 54 represents the gain of the antenna 12 for transmission and/or reception. It should be understood that the greater the distance the radiation pattern 54 extends from the centre of the Cartesian co-ordinate system 20, the greater the gain of the antenna 12 in that direction.

The radiation pattern 54 has a ring shape with a diameter that extends in the plane formed by the X axis 22 and the Z axis 26. The circumference section of the ring shape may be considered as a main lobe of the radiation pattern 54 (that is, the circumference is the portion of the radiation pattern 54 where the gain of the antenna 12 is greatest). The ring shape of the radiation pattern 54 also has a depth that extends in the Y axis 24 and is smaller than the diameter of the of the ring shape. The depth of the radiation pattern 54 is greatest ar ound the circumference of the ring shape and smallest at the centre of the ring shape.

It should be understood that the various portions 46, 48, 50 and 52 of the antenna 12 contribute to the radiation pattern 54 of the antenna 12. The orientation of the first portion 46 results in current in the first portion 46 of the antenna 12 flowing in the X-Z plane. Since the electric field strength of the antenna 12 is at a maxima in the first portion 46, this in turn results in the main lobe of the radiation pattern 54 extending substantially also in the X-Z plane.

The second, third and fourth portions 48, 50, 52 also contribute to the direction of the radiation pattern 54. For example, the orientation of the second portion 48 results in current in the second portion 48 flowing in the X-Y plane. This in turn provides a contribution to the radiation pattern 54 that extends in the X-Y plane. The orientation of the third portion 50 results in current in the third portion 50 flowing in the X-Y plane. This in turn provides a contribution to the radiation pattern 54 that extends in the X-Y plane. The orientation of the fourth portion 52 results in current in the fourth portion 52 flowing in the Y-Z plane. This in turn provides a contribution to the radiation pattern 54 that extends in the Y-Z plane.

Embodiments of the present invention provide several advantages. One such advantage is that the orientation of the portions 46, 48, 50, 52 may enable the main lobe of the radiation pattern 54 to be directed in any desired direction. In particular, the orientation of the first portion 46 is different to the orientation of the printed wiring board 18 and may result in the main lobe of the radiation pattern 54 being directed away from the printed wiring board 18.

In various embodiments, the printed wiring board 18 may include a plurality of electronic components which may produce electromagnetic noise. The antenna 12 illustrated in FIG. 2 provides an advantage in that the radiation pattern 54 does not substantially extend towards the printed wiring board 18 (that is, it does not substantially extend in the Y axis 24 over the printed wiring board 18) due to the orientation of the first portion 46. Consequently, the antenna 12 does not substantially receive the electromagnetic noise produced by the electronic components on the printed wiring board 18.

As mentioned above, embodiments of the invention may reduce noise received by the antenna 12 from electronic components on the printed wiring board. This may enable a manufacturer to connect the antenna 12 to the radio circuitry 14 without an additional amplifier and/or a noise filter provided there between. In various embodiments, the radio circuitry 14 may include a low noise amplifier in the radio circuitry 14 integrated circuit. Embodiments of the invention may enable the manufacturer to connect the antenna 12 to the radio circuitry 14 without an additional amplifier between the low noise amplifier and the antenna 12. This may result in the apparatus 10 being less expensive.

Embodiments of the invention may be advantageous when the radio circuitry 14 and the antenna 12 are operable at frequencies where the electrical length of the antenna 12 is different to the optimum electrical length. In portable electronic devices, there may be insufficient space for the antenna 12 to have an optimum electrical length. This may be particularly true for relatively low frequencies such as FM radio frequencies. For example, the electrical length of antenna 12 may be approximately 10 cm to 25 cm whereas the optimum electrical length may be approximately 200 cm to 400 cm for FM radio frequencies. In such instances the gain of an antenna may be relatively low and the antenna may therefore be susceptible to electromagnetic noise. Embodiments of the present invention provide an advantage in that they may enable an antenna having a non-optimal electrical length to be used for transmission and/or reception of signals due to the reduction in noise at the antenna 12.

Furthermore, the second portion 48 and/or the third portion 50 may be configured to have electrical lengths that enable the antenna 12 to operate more efficiently in a desired operational frequency band. For example, the antenna 12 may be desired to operate at FM radio frequencies and the second portion 48 and/or the third portion 50 may be configured to electrically lengthen the antenna 12 so that it may more efficiently operate at FM frequencies. Consequently, the second portion 48 and/or the third portion 50 may increase the gain of the antenna 12 and may therefore function, at least in part, as gain boost portions of the antenna 12.

As mentioned above, the first portion 46 and the fourth portion 52 extend above and below the printed wiring board 18. This may provide an advantage in that the radiation pattern 54 is relatively unaffected by the printed wiring board 18 and is not, for example, reduced in gain in the −Z direction.

It should be understood that embodiments of the present invention are not limited to the antenna 12 described above with reference to FIG. 2 and it should be appreciated that the antenna 12 may have different shapes and configurations. For example, the first portion 46 may have any orientation that is different to the orientation of the ground member. For example, the first portion 46 may be oriented parallel to the Y-Z plane or may be oriented parallel to a plane that has any positive and/or negative X, Y and Z components. The first portion 46 may have an orientation that directs the radiation pattern away from a particular electronic component (for example, a display). Additionally, the portions 46, 48, 50, 52 of the antenna 12 may not be planar and may be curved (to match a casing of the apparatus 10 for example). Furthermore, the antenna 12 may have any number of gain boost portions (including none) and these may have any orientation relative to the ground member.

Figure 4:
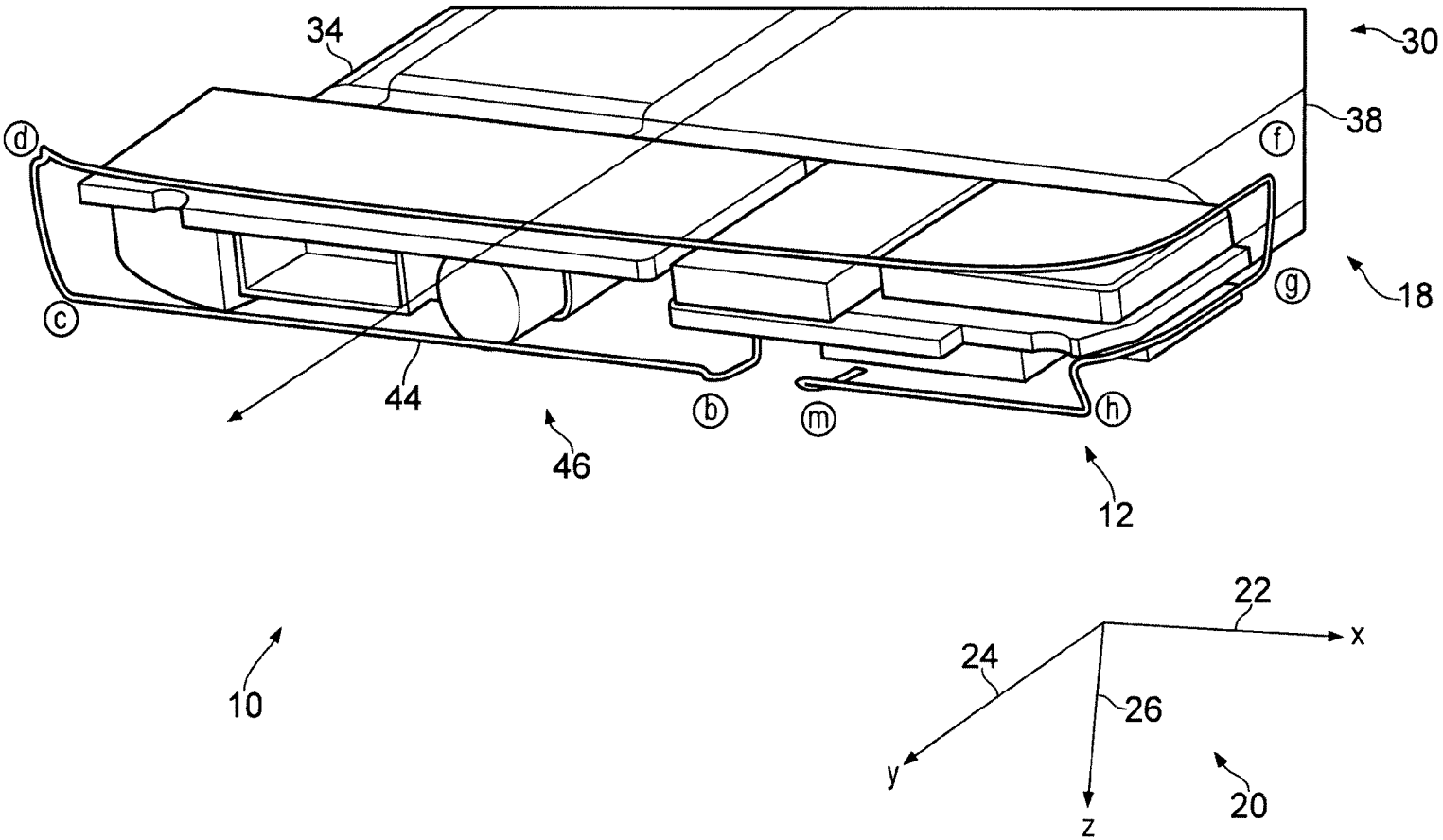
FIG. 4 illustrates a perspective view of another apparatus according to various embodiments of the invention.

FIG. 4 illustrates a perspective diagram of another apparatus 10 according to various embodiments of the invention. The apparatus 10 illustrated in FIG. 4 is similar to the apparatus illustrated in FIG. 2 and where the features are similar, the same reference numerals are used. FIG. 4 also illustrates the Cartesian co-ordinate system 20.

The apparatus 10 illustrated in FIG. 4 differs from the apparatus 10 illustrated in FIG. 2 in that the conductive track 44 does not include parts between positions (i) to (l) (that is, the second portion 48) and instead, the conductive track 44 is continuous between positions (h) to (m). Furthermore, the conductive track 44 is connected to a feed point(s) 40 (not illustrated in FIG. 4) that is positioned in closer proximity to the fourth side edge 38 of the printed wiring board 18 than the second side edge 34. Additionally, the conductive track 44 at positions (b) to (m) does not have right angled turns but instead has curved portions. This may be advantageous since it may be easier for manufacturer to produce an antenna with curved portions instead of an antenna with right angled turns.

Figure 5:
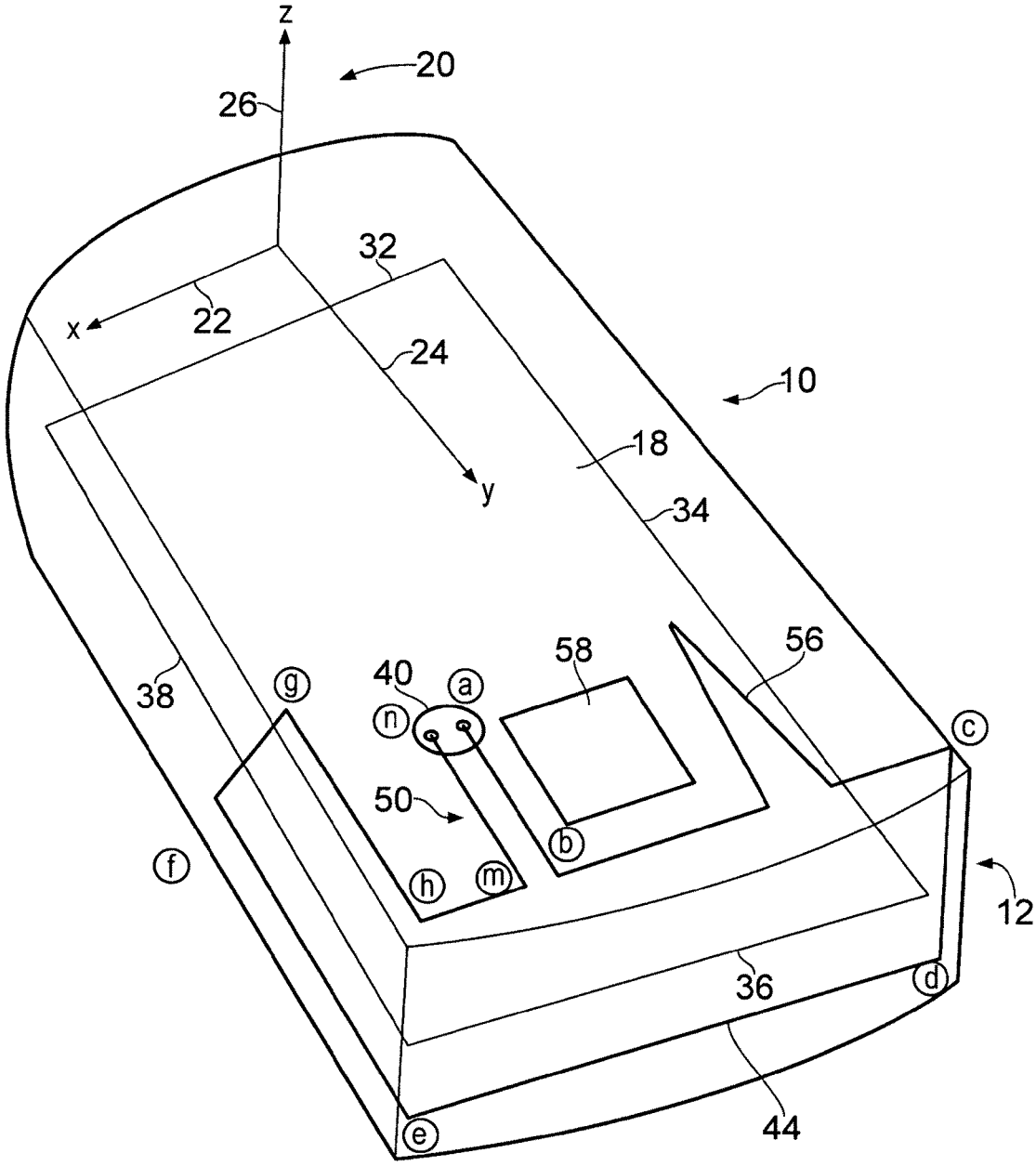
FIG. 5 illustrates a perspective view of a further apparatus according to various embodiments of the invention.

FIG. 5 illustrates a perspective diagram of a further apparatus 10 according to various embodiments of the invention. The apparatus 10 illustrated in FIG. 5 is similar to the apparatus illustrated in FIG. 2 and in FIG. 4 and where the features are similar, the same reference numerals are used. FIG. 5 also illustrates the Cartesian co-ordinate system 20.

The apparatus 10 illustrated in FIG. 5 differs from the apparatus 10 illustrated in FIG. 2 in that the conductive track 44 does not include parts between positions (i) to (l) (that is, the second portion 48) and instead, the conductive track 44 is continuous between positions (h) to (m). Furthermore, the conductive track 44 is connected to a feed point(s) 40 that is positioned in closer proximity to the fourth side edge 38 of the printed wiring board 18 than the second side edge 34. In between positions (b) and (c), the conductive track 44 includes a fifth portion 56 that forms a triangular shape in the X-Y plane that extends in the −Y direction. The fifth portion 56 may be shaped and oriented to assist in directing the main lobe of the radiation pattern in a particular direction and may also function as a gain boost portion.

The apparatus 10 may also include one or more electronic components 58 (such as a camera module) that are positioned between the third portion 50 and the fifth portion 56. This arrangement may be advantageous since it utilizes empty space between the antenna 12 portions for other electronic components and may enable a manufacturer to make the apparatus 10 smaller in size.

Figure 6A:
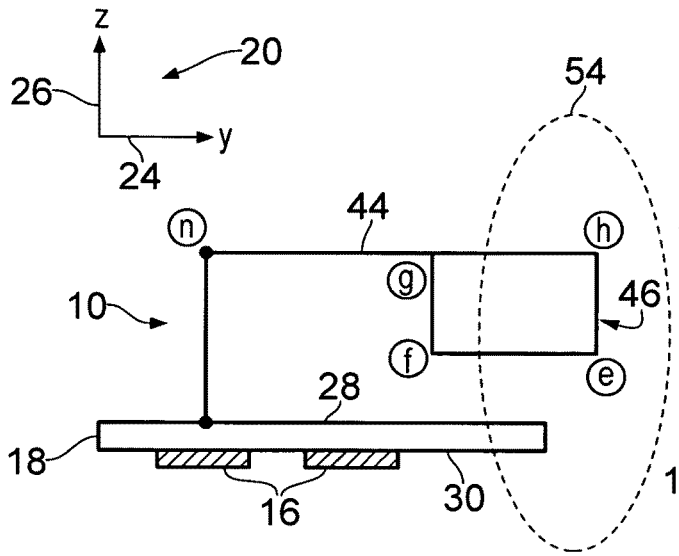
FIGS. 6A & 6B illustrate different side views of another apparatus according to various embodiments of the invention.
Figure 6B:
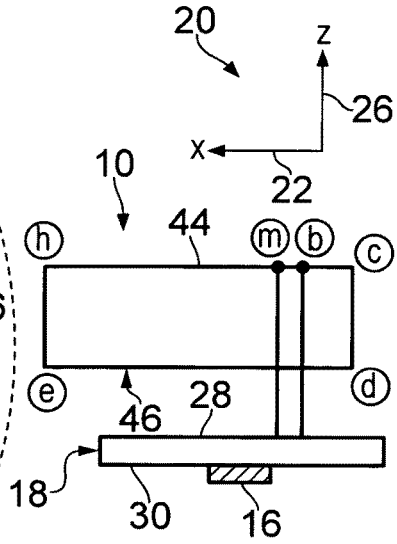

FIGS. 6A and 6B illustrate side view diagrams of another apparatus 10 according to various embodiments of the invention. The apparatus 10 illustrated in FIGS. 6A & 6B is similar to the apparatus illustrated in FIG. 2 and where the features are similar, the same reference numerals are used. FIGS. 6A and 6B also illustrate the Cartesian co-ordinate system 20.

The apparatus 10 illustrated in FIGS. 6A and 6B differs from the apparatus 10 illustrated in FIG. 2 in that the conductive track 44 does not include parts between positions (i) to (l) (that is, the second portion 48) and instead, the conductive track 44 is continuous between positions (h) to (m). Furthermore, the length of the conductive track 44 between positions (c) to (d) and (f) to (g) is less than the height of the antenna 12 above of the printed wiring board 18. Consequently, the first portion 46 is positioned wholly above the top surface 28 of the printed wiring board 18 and does not extend below the bottom surface 30 of the printed wiring board 18.

FIG. 6A also illustrates the radiation pattern 54 of the antenna 12 and the functional circuitry 16 which may be a source of noise for the antenna 12. The main lobe of the radiation pattern 54 is oriented in the X-Z plane and is directed away from the functional circuitry 16. As mentioned above, this may advantageously reduce the effect of the noise produced by the functional circuitry 16 on the antenna 12. Furthermore, since the first portion 46 is positioned above the top surface 28 of the printed wiring board 18 and the functional circuitry 16 is positioned on the bottom surface 30 of the printed wiring board 18, the radiation pattern 54 is positioned further away from functional circuitry 16 and the antenna 12 may be less effected by the noise of the functional circuitry 16.

Figure 7A:
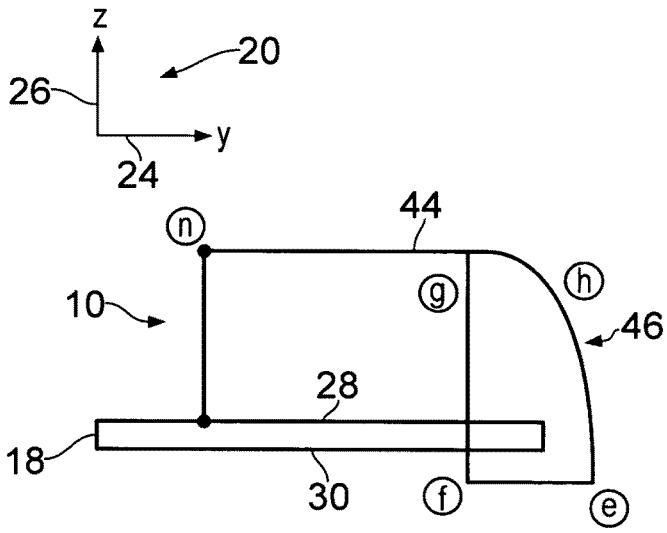
FIGS. 7A & 7B illustrate different side view of a further apparatus according to various embodiments of the invention.
Figure 7B:
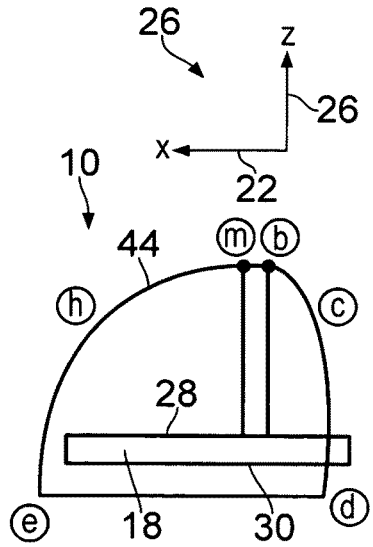

FIGS. 7A and 7B illustrate side view diagrams of a further apparatus 10 according to various embodiments of the invention. The apparatus 10 illustrated in FIGS. 7A & 7B is similar to the apparatus illustrated in FIG. 2 and where the features are similar, the same reference numerals are used. FIGS. 7A and 7B also illustrate the Cartesian co-ordinate system 20.

The apparatus 10 illustrated in FIGS. 7A and 7B differs from the apparatus 10 illustrated in FIG. 2 in that the conductive track 44 does not include parts between positions (i) to (l) (that is, the second portion 48) and instead, the conductive track 44 is continuous between positions (h) to (m). Furthermore, the conductive track 44 is curved between positions (c) to (d) and (f) to (g) to match the curvature of a casing of the apparatus 10.

Figure 8:
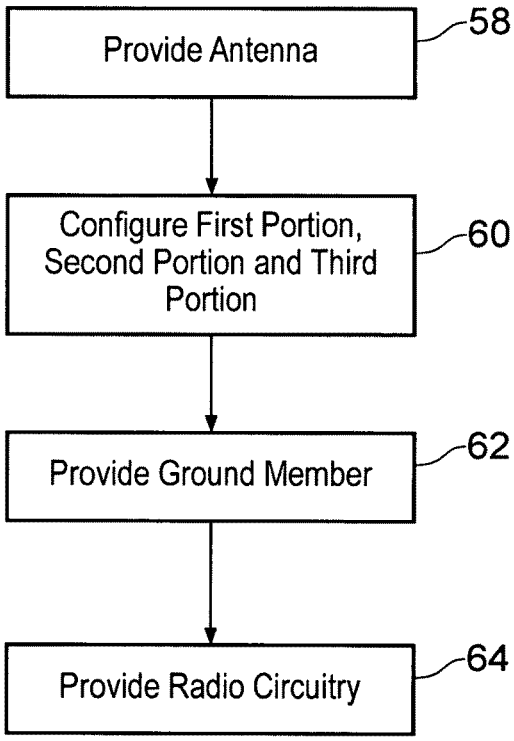
FIG. 8 illustrates a flow diagram of a method of manufacturing an apparatus according to various embodiments of the invention.

FIG. 8 illustrates a flow diagram of a method for manufacturing an antenna according to various embodiments of the present invention. In the following description, the method will be described in relation to the features illustrated in FIGS. 1 and 2. However, it should be appreciated that the method is not limited to the manufacture of the illustrated antenna only and that the method is applicable to various embodiments of the invention.

At block 58, the method includes providing the antenna 12. At block 60, the method includes configuring the first portion 46, the second portion 48, the third portion 50 and the fourth portion 52 to have desired electrical lengths and orientations. For example, the portions 46, 48, 50 and 52 may be sized and shaped to have the lengths and orientations of the antenna 12 illustrated in FIG. 2. At block 62, the method includes providing the ground member 18. Block 62 may also include connecting the antenna 12 to the feed point(s) 40 on the printed wiring board 18. At block 64, the method includes providing the radio circuitry 14 and may also include connecting the radio circuitry 14 to the antenna 12 without providing an intervening amplifier between the radio circuitry 14 and the antenna 12.

The blocks illustrated in the FIG. 4 may represent steps in a method and/or sections of code in one or more computer programs (to be executed by one or more processors controlling manufacturing machinery). The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed. For example, the antenna 12 may be incorporated into a casing of an apparatus 10.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a ground member oriented in a first orientation;

at least one feed point configured to couple to radio circuitry; and an antenna including a first portion having a non-overlaying arrangement with the ground member, the first portion being oriented in a second orientation, different to the first orientation, wherein the first portion is positioned outside of a perimeter of the ground member, wherein the antenna includes a second portion, extending from the first portion, having an overlaying arrangement with the ground member, the second portion being oriented in the first orientation, and the second portion being configured to have an electrical length, wherein the antenna includes a third portion formed proximate an end of the first portion, having an overlaying arrangement with the ground member, and being oriented in the first orientation, wherein the third portion comprises at least one feed leg, the at least one feed leg being coupled to the at least one feed point, wherein the third portion is configured to have an electrical length, wherein the antenna includes a fourth portion having a non-overlaying arrangement with the ground member, the fourth portion being oriented in a third orientation, different to the first and second orientations, wherein the antenna comprises a single conductive track configured to extend between a first end of the track and a second end of the track at least via the third portion, a part of the first portion, the second portion, another part of the first portion, the fourth portion, and a further part of the first portion, and wherein the first end of the track is coupled to the feed leg.

2. The apparatus as claimed in claim 1, wherein the orientation of the first portion is configured to provide the antenna with a radiation pattern including a main lobe oriented away from a noise source.

3. The apparatus as claimed in claim 1, wherein the second portion, third portion, and first orientation are configured to provide the antenna with a radiation pattern including a main lobe oriented away from a noise source.

4. The apparatus as claimed in claim 1, further comprising radio circuitry configured to process signals from the antenna, wherein a connection between the antenna and the radio circuitry is without an amplifier.

5. The apparatus as claimed in claim 1, wherein the fourth portion lies in a plane that is substantially parallel with a plane defined by a Y axis and a Z axis, wherein the fourth portion is substantially perpendicular to the ground element, and wherein current through the fourth portion supports a radiation pattern of the antenna in the Y axis and the Z axis.

6. The apparatus as claimed in claim 1, wherein the ground member comprises a top surface and a bottom surface.

7. The apparatus as claimed in claim 1, wherein the first orientation is substantially perpendicular to the second orientation.

8. A portable electronic device comprising the apparatus as claimed in claim 1.

9. A module comprising the apparatus as claimed in claim 1.

10. A module as claimed in claim 9, further comprising a cover for a portable electronic device, the antenna being incorporated into the cover.

11. The apparatus as claimed in claim 1, wherein the third portion comprises two feed legs, and wherein the apparatus further comprises a switch configured to connect in a first position one feed leg to a feed point and another feed leg to an open circuit, whereby the antenna is configured to operate as a monopole antenna.

12. The apparatus as claimed in claim 11, wherein the switch is further configured to connect in a second position one feed leg to the first feed point and the other feed leg to a second feed point, whereby the antenna is configured to operate as a loop antenna.

13. A method comprising:

providing a ground member oriented in a first orientation; and providing at least one feed point configured to couple to radio circuitry;

providing an antenna including a first portion having a non-overlaying arrangement with the ground member and the first portion being oriented in a second orientation, different to the first orientation, wherein the first portion is positioned outside of a perimeter of the ground member, wherein the antenna includes a second portion, extending from the first portion, having an overlaying arrangement with the ground member, the second portion being oriented in the first orientation, and the second portion being configured to have an electrical length wherein the antenna includes a third portion formed proximate an end of the first portion, having an overlaying arrangement with the ground member, and being oriented in the first orientation, wherein the third portion comprises at least one feed leg, the at least one feed leg being coupled to the at least one feed point, wherein the third portion is configured to have an electrical length, wherein the antenna includes a fourth portion having a non-overlaying arrangement with the ground member, the fourth portion being oriented in a third orientation, different to the first and second orientations, wherein the antenna comprises a single conductive track configured to extend between a first end of the track and a second end of the track at least via the third portion, a part of the first portion, the second portion, another part of the first portion, the fourth portion, and a further part of the first portion, and wherein the first end of the track is coupled to the feed leg.

14. The method as claimed in claim 13, further comprising configuring the orientation of the first portion to provide the antenna with a radiation pattern including a main lobe oriented away from a noise source.

15. The method as claimed in claim 13, further comprising providing radio circuitry configured to process signals from the antenna, wherein a connection between the antenna and the radio circuitry is without an amplifier.

16. The method as claimed in claim 13, wherein the fourth portion lies in a plane that is substantially parallel with a plane defined by a Y axis and a Z axis, wherein the fourth portion is substantially perpendicular to the ground element, and wherein current through the fourth portion supports a radiation pattern of the antenna in the Y axis and the Z axis.

17. The method as claimed in claim 13, wherein the third portion comprises two feed legs, and wherein the method further comprises providing a switch configured to connect in a first position one feed leg to a feed point and another feed leg to an open circuit, whereby the antenna is configured to operate as a monopole antenna.

18. The method as claimed in claim 17, wherein the switch is further configured to connect in a second position one feed leg to the first feed point and the other feed leg to a second feed point, whereby the antenna is configured to operate as a loop antenna.

* * * * *